US011345527B2

(12) United States Patent
Paganuzzi

(10) Patent No.: US 11,345,527 B2
(45) Date of Patent: May 31, 2022

(54) SAFETY CAPSULE WITH STRIP FOR PREVENTING EXTRACTION

(71) Applicant: BORMIOLI PHARMA S.P.A., Milan (IT)

(72) Inventor: Valerio Paganuzzi, Parma (IT)

(73) Assignee: BORMIOLI PHARMA S.P.A., Milan (IT)

( * ) Notice: Subject to any disclaimer, the term of this patent is extended or adjusted under 35 U.S.C. 154(b) by 39 days.

(21) Appl. No.: 16/607,766

(22) PCT Filed: Apr. 24, 2018

(86) PCT No.: PCT/IB2018/052842

§ 371 (c)(1),
(2) Date: Oct. 24, 2019

(87) PCT Pub. No.: WO2018/198027

PCT Pub. Date: Nov. 1, 2018

(65) Prior Publication Data

US 2020/0055647 A1 Feb. 20, 2020

(30) Foreign Application Priority Data

Apr. 28, 2017 (IT) ..... 102017000046734

(51) Int. Cl.

| | |
|---|---|
| ***B65D 41/34*** | (2006.01) |
| ***B65D 50/04*** | (2006.01) |
| *B65D 51/18* | (2006.01) |

(52) U.S. Cl.

CPC ..... *B65D 50/041* (2013.01); *B65D 51/18* (2013.01); *B65D 2215/02* (2013.01); *B65D 2401/20* (2020.05)

(58) Field of Classification Search

CPC .. B65D 50/041; B65D 50/00; B65D 2401/20; B65D 2215/02; B65D 41/3428;

(Continued)

(56) References Cited

U.S. PATENT DOCUMENTS 2,124,873 A * 7/1938 Conner ..... B65D 50/041 215/251
3,944,102 A * 3/1976 Grau ..... B65D 50/041 215/251

(Continued)

FOREIGN PATENT DOCUMENTS

CN 2338299 Y 9/1999
CN 2438678 Y 7/2001

(Continued)

*Primary Examiner* — Gideon R Weinerth
(74) *Attorney, Agent, or Firm* — Pearne & Gordon LLP

(57) ABSTRACT

A safety capsule for a container, comprising:

a threaded closure cap (2) for closing the container;

a cover (3) for said cap (2), said cover (3) comprising a base (30) and a lateral wall (31) that extends from said base (30); said base (30) and said lateral wall (31) overlying said cap (2);

a press-fit engagement means (5) that enables transmission of motion from the cover (3) to the cap (2) for unscrewing said cap (2);

means (6) preventing extraction of the cover (3) from the cap (2), said means (6) comprising:

a) a strip (60), being part of the cover (3), bent towards the inside of the cover (3);

b) a stopping abutment (61), being part of the cap (2), intended to abut said strip (60) at least whenever there is an attempt to pull out the cap (2) from the cover (3).

7 Claims, 1 Drawing Sheet

(58) Field of Classification Search
CPC ..... B65D 55/0863; B65D 51/18; B65D 2251/0015; B65D 2251/0046
USPC ..... 215/252, 250, 201, 208, 254, 231, 232, 215/204, 220, 272, 274; 206/807
See application file for complete search history.

(56) References Cited

U.S. PATENT DOCUMENTS 4,402,418 A * 9/1983 Ostrowsky ..... B65D 41/3428 215/252
4,433,789 A * 2/1984 Gibilisco ..... B65D 50/041 215/220
4,474,301 A 10/1984 Davis
4,516,684 A * 5/1985 Walter ..... B65D 45/322 215/274
4,523,688 A * 6/1985 Puresevic ..... B65D 50/041 215/220
4,550,844 A * 11/1985 Lininger ..... B65D 41/3428 215/252
4,607,759 A * 8/1986 Boetzkes ..... B67D 1/125 215/251
4,730,745 A * 3/1988 Perry ..... B65D 55/0863 215/230
4,782,965 A 11/1988 Wassilieff
5,443,171 A * 8/1995 Sprowl ..... B65D 41/3428 215/252
5,445,283 A * 8/1995 Krautkramer ..... B65D 50/041 215/218
5,829,612 A * 11/1998 Zumbuhl ..... B65D 41/3428 215/252
5,875,906 A 3/1999 Price et al.
5,979,682 A * 11/1999 Zumbuhl ..... B65D 41/3428 215/252
6,085,920 A * 7/2000 Moretti ..... B65D 41/34 215/220
6,253,939 B1 * 7/2001 Wan ..... B65D 41/3428 215/901
6,575,319 B2 * 6/2003 Zumbuhl ..... B65D 41/0421 215/252
7,850,028 B2 * 12/2010 Morini ..... B65D 41/3428 215/220
7,878,351 B2 * 2/2011 Falzoni ..... B65D 41/3428 215/252
10,457,452 B2 * 10/2019 Paganuzzi ..... B65D 41/3428
10,940,983 B2 * 3/2021 Paganuzzi ..... B65D 51/2842
11,267,624 B2 * 3/2022 Berge ..... B65D 51/18
2001/0002661 A1 * 6/2001 Reidenbach ..... B65D 41/3428 215/252
2002/0096485 A1 * 7/2002 Zumbuhl ..... B65D 41/3428 215/252
2005/0161425 A1 7/2005 Morini
2006/0151423 A1 * 7/2006 Seidita ..... B65D 41/325 215/341
2007/0257002 A1 * 11/2007 Pucci ..... B65D 41/3428 215/252
2010/0237072 A1 9/2010 Ahn
2011/0147334 A1 * 6/2011 Mettu ..... B65D 50/041 215/219
2013/0213923 A1 * 8/2013 Krautkramer ..... B65D 41/3428 215/252
2018/0093802 A1 * 4/2018 Paganuzzi ..... B65D 41/3428
2019/0119016 A1 * 4/2019 Paganuzzi ..... B65D 51/285
2019/0344933 A1 * 11/2019 Kim ..... B65D 41/0414
2020/0055647 A1 * 2/2020 Paganuzzi ..... B65D 41/3423

FOREIGN PATENT DOCUMENTS

DE 29606358 U1 8/1996
WO 0034133 A2 6/2000
WO 03093129 A1 11/2003

* cited by examiner

SAFETY CAPSULE WITH STRIP FOR PREVENTING EXTRACTION

TECHNICAL FIELD

The present invention relates to a (child-proof) safety capsule for a container.

BACKGROUND ART

Child-proof safety capsules are known that comprise a closure cap for closing a container and a cover that surmounts said cap.

Let us define an axial direction identified by the extension direction of the neck of the container. In order to allow the opening of the capsule a thrust must be exerted on the cover along such axial direction (so as to cause said cover and said cap to mutually engage) and at the same time a rotation of the cover in a first direction; in fact, it has been proven that the coordinated combination of these two movements is particularly difficult for children below the age of 6 years. This prevents a child from being able to accidentally access the contents of the container. Similar applications are typically used in containers designed to contain pharmaceutical products. In safety capsules the cover performs the function of preventing an external user being able to directly access the cap. A lateral wall of the cover comprises an annular projection that projects towards the cap perpendicularly to the axial direction. Likewise an annular abutment projects towards the cover perpendicularly to the axial direction and is positioned immediately below the above-mentioned annular projection. This prevents that by pulling the cover along said axial direction the cover can be removed, thus making the underlying cap accessible.

A drawback of this solution is linked to the fact that should a child exert a force such as to lift only a portion of the lower circumferential edge of the cover, the child might deform the edge so that the annular abutment would no longer be able to retain the annular projection and therefore would no longer be able to retain the cover (de-capping).

U.S. Pat. No. 4,782,965, WO03/093129, WO00/34133, DE29606358 disclose closure systems.

DISCLOSURE OF THE INVENTION

In this context, the technical task underlying the present invention is to propose a safety capsule which obviates the drawbacks in the known art as described above.

In particular, an object of the present invention is to provide a safety capsule that enables minimising the risk of de-capping of the capsule. The stated technical task and specified objects are substantially achieved by a safety capsule comprising the technical features disclosed in one or more of the appended claims.

BRIEF DESCRIPTION OF DRAWINGS

Further characteristics and advantages of the present invention will become more apparent from the following indicative, and hence non-limiting, description of a preferred, but not exclusive, embodiment of a capsule, as illustrated in the appended drawings, in which.

Figure 1:
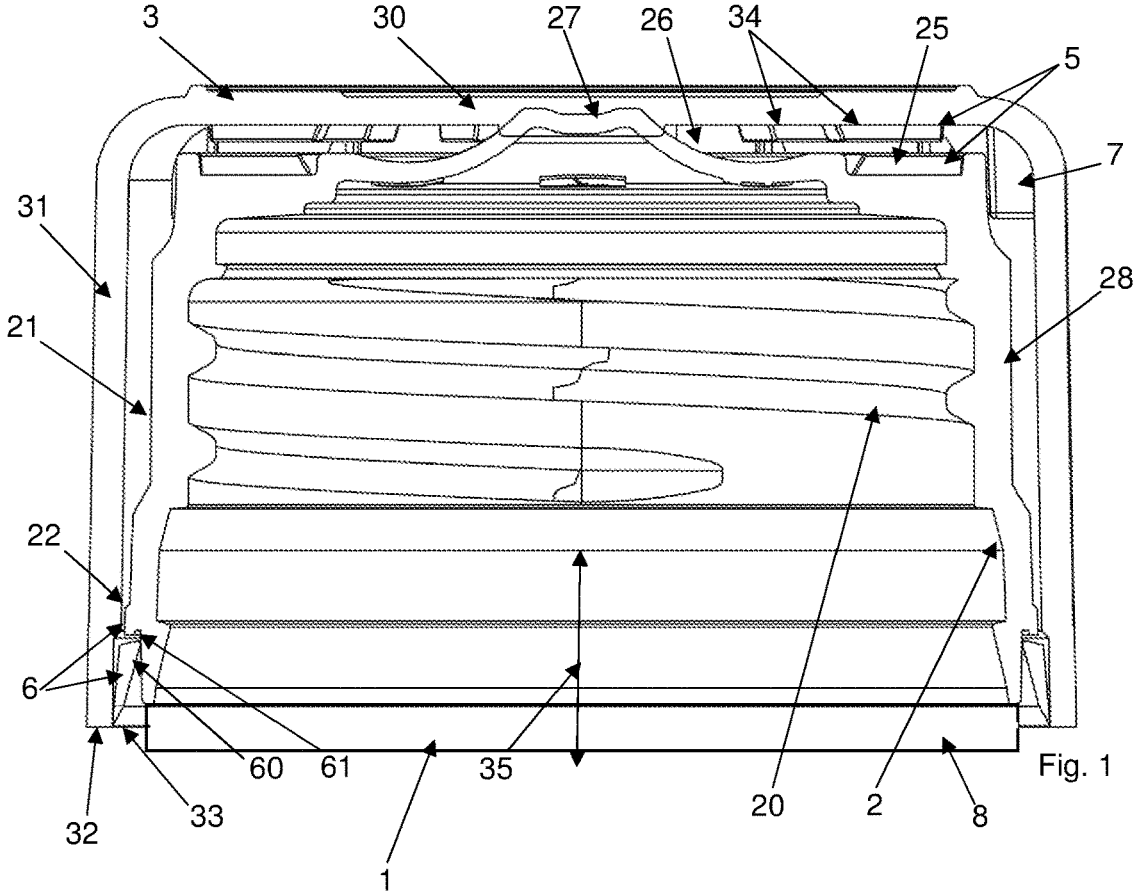
FIG. 1 is a section view of a capsule according to the present invention.

In the appended figures reference number 1 denotes a safety capsule (also known in the technical sector as a child-proof capsule) of a container.

DETAILED DESCRIPTION OF PREFERRED EMBODIMENTS OF THE INVENTION

The safety capsule 1 is used to enable opening and closing of a mouth of a container, but at the same time it is used for preventing accidental access to the contents of the container (for example by a child). The capsule 1 is typically applied to a neck of a container. The capsule 1 is in particular used for pharmaceutical applications.

The capsule 1 comprises a closing cap 2 of the container. The cap 2 comprises a thread 20 for connection to the container. The thread 20 enables the cap 2 to be screwed to the container in order to enable closing and unscrewing the cap 2 from the container to allow extraction of the product contained therein.

The capsule 1 further comprises a cover 3 of the cap 2.

The cover 3 comprises a base 30 and a lateral wall 31 which extends from the base 30. Appropriately the cover 3 is a single body. The cover 3 is shaped as an upturned beaker. An axial extension direction 35 of the capsule 1 is defined by a straight line that is perpendicular to the base 30. The cap 2 and/or the cover 3 appropriately have a cylindrical symmetry about an axis of symmetry orientated according to the axial direction 35. The base 30 and the lateral wall 31 are superimposed on the cap 2.

The base 30 is located at the opposite end with respect to a zone of the capsule 1 comprising an intactness band 8 destined to connect to the container (the intactness band 8 makes the capsule 1 "tamper evident"; breaking the band 8 therefore indicates that the product has already been opened). The intactness band 8 is however not necessarily present. It is illustrated schematically in the appended figures.

The intactness band 8 is usually connected to the remaining parts of the cap 2 by means of yielding bridges. Before breaking, the bridges connect the band to remaining parts of the cap 2. The intactness band 8 is therefore at a lower portion of the cap 2 (considering the capsule applied to a container provided with a bottom which rests on a horizontal plane). The intactness band 8 must be broken to enable correct operation of the capsule 1.

The cap 2 is preferably made of a plastic material, for example polypropylene or HDPE. The cover 3 is preferably made of a plastic material, for example polypropylene or HDPE. The cover 3 is preferably made in a single, monolithic body.

The capsule 1 comprises a press-fit engagement means 5 that places said cap 2 and said cover 3 into operative communication, enabling transmission of motion from the cover 3 to the cap 2 for the purpose of making it possible to unscrew said cap 2.

If the press-fit engagement means 5 is not activated and a user attempts to unscrew the capsule 1 from the container, the cover 3 turns freely and without engaging with the cap 2. The press-fit engagement means 5 is at least partly integrated in said cap 2 and in said cover 3. In particular, the press-fit engagement means 5 may comprise fins 34 afforded in a single piece with the remaining parts of the cover 3 which are engaged in relevant seats 25 afforded in the cap 2. In particular the fins 34 could be afforded in the base 30 of the cover and advantageously they are arranged radially.

The capsule 1 further comprises extraction prevention means 6 of the cover 3 from the cap 2. The extraction prevention means 6 is therefore an anti de-capping means.

The extraction prevention means 6 carries out an action that opposes a separation of the cover 3 from the cap 2 following application of a force directed perpendicularly to the base 30.

The extraction prevention means 6 is partly integrated in the cover 3 and at least partly in the cap 2. The extraction prevention means 6 appropriately does not comprise threaded means. The cover 3 and the cap 2 are therefore inseparable (if not by applying a very strong force or by damaging or deforming the product).

The extraction prevention means 6 comprises:

a) a strip 60, being part of the cover 3 bent towards the inside of the cover 3; (it is folded internally of a concavity defined by the cover 3 and in which the cap 2 is housed);

b) a stopping abutment 61, being part of the cap 2, intended to abut said strip 60 at least whenever there is an attempt to pull out the cap 2 from the cover 3 (for example by pulling the cap 2 and the cover 3 in opposite directions).

The cap 2 comprises a lateral flank 21 in which the abutment 61 is afforded. The lateral flank 21 extends by a side of the lateral wall 31 of the cover 3.

The cap 2 further comprises a portion 26 which faces the base 30. The portion 26 advantageously comprises a spring 27 that opposes the enmeshing of the engagement means 5. This spring 27 tends to disengage the engaging means 5. When the engaging means 5 is activated by the operator the spring 27 is compressed by the base 30. When the pushing action by the user is released, the spring 27 determines disengagement of the engagement means 5.

The strip 60 is located at one end 32 of the cover 3 which is opposite said base 30.

The flank 21 of the cap 2 comprises a projection 22 in which the abutment 61 is afforded and which extends along an imaginary annular line. The projection 22 is therefore annular. Preferably, though not necessarily, it extends continuously with no interruption.

The abutment 61 comprises a groove 610 in which said strip 60 wedges whenever an attempt is made to pull out the cap 2 from the cover 3. The groove 610 can be annular. The abutment 61 can comprise a surface that is perpendicular or in any case transversal with respect to said axial direction 35.

The strip 60 extends starting from a fold line 33. The fold line 33 enables connecting the strip 60 with other parts of the cover 3. The fold line 33 is made at an end 32 that is opposite the base 30. Starting from said fold line 33, the strip 60 extends towards the base 30. It extends in an upwards direction.

The strip 60, at an end 601 thereof that is distanced from said fold line 33, comprises a wedge 602 destined to abut the abutment 61. The wedge 602 is preferably destined to partly insert in the groove 610 at least if an attempt is made to separate the cover 3 and the cap 2.

Figure 2:
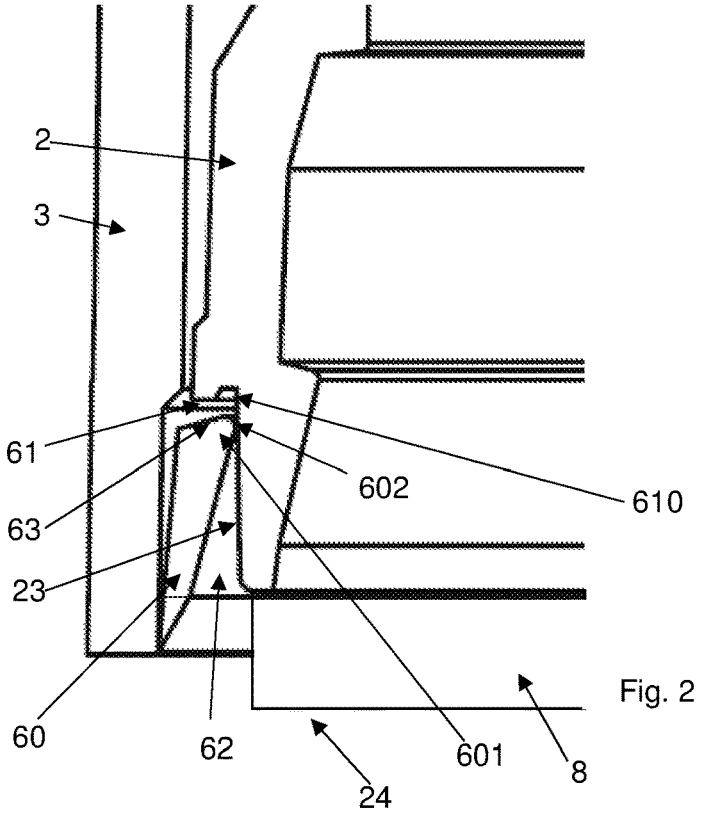
FIG. 2 shows a detail of FIG. 1 in larger scale.

As shown by way of example in FIG. 2, over the whole extension thereof the strip 60 is substantially close to the lateral wall 31 of the cover 3.

As shown by way of example in FIG. 1, a surface 63 of the strip 60 destined to abut said abutment 61 is shaped as a ring converging towards the axis of the capsule 1.

As shown by way of example in FIG. 1, the folded strip 60 overlies the lateral wall 31 of the cover 3, without any interposed elements.

The flank 21 of the cap 2 comprises an annular portion 23 that extends between said annular projection 22 (or in any case said abutment 61) and an end 24 of the cap 2. This is, in particular, an end of the cap 2 in which the intactness band 8 is afforded.

The strip 60 is located at least partly in a gap 62 placed between the lateral wall 31 of the cover 3 and the annular portion 23 of the cap 2.

In a particular embodiment, the extraction prevention means 6 comprises a plurality of adjacent strips 6 abutted by one or more projections 22 afforded on the flank 21 of the cap 2 and interposed between the lateral wall 31 of the cover 3 and the annular portion 23 of the cap 2.

The press-fit engagement means 5 determines a maximum axial stroke of the cover 3 with respect to the cap 2. The annular portion 23 extends axially for a greater length than said maximum axial stroke. This prevents the exiting of the strip 6 from said gap 62.

The capsule 1 advantageously further comprises means for closing the cap 2 on the container 3 following opening and which are in part integrated in the cap 2 and in part integrated in the cover 3. In particular the means for closing the cap 2 comprise a first fin 28 which projects towards the lateral wall 31 of the cover 3. The means for closing the cap 2 comprise a second fin (not illustrated) which projects from the lateral wall 31 of the cover 3 towards the cap 2.

The first fin 28 and the second fin preferably form an angle that is not zero with respect to a radial direction (in other words the fins are not orientated radially with respect to an axis orientated perpendicularly to said base 30 and passing through the geometric centre of gravity of the capsule 1). A first rotation direction of the cover 3 determines the contemporary engaging of the first fin 28 and the second fin. The first rotation direction is such as to determine the closing of the capsule 1. In fact the first rotation direction enables transmission of motion from the cover 3 to the cap 2 and the consequent screwing of the cap 2 onto the container.

A second rotation direction of the cover 3 determines the sliding of the first fin 28 and the second fin (in this case the upper surfaces of the first fin 28 and the second fin 36 slide on one another). The second rotation direction is opposite the first rotation direction. The second rotation direction is the same rotation direction that would determine the unscrewing of the cap 2 from the container in a case in which the press-fit engagement means 5 were activated.

It is further of note that the cover 3 comprises teeth 7 located at the connecting zone of said base 30 and said lateral wall 31. The teeth 7 face and in particular abut the cap 2. The teeth 7 contribute to holding the cap 2 in position with respect to the cover 3. In fact the teeth 7 contribute to maintaining the coaxiality between the cap 2 with the cover 3, in particular the base 30.

The present invention provides important advantages.

Primarily it enables greater effectiveness in preventing de-capping of the capsule by a child (a dangerous operation as it determines the removal of the cover 3, leaving free access to the underlying cap 2 and thus enabling opening thereof by simple unscrewing). The use of a folded strip 60 offers a much greater resistance to the de-capping action. Further, the greater the force applied to extract the cap 2 from the cover 3, the greater the resistance offered by the strip 60 will be.

The invention as it is conceived is susceptible to numerous modifications and variants, all falling within the scope of the inventive concept characterising it. Further, all the details can be replaced with other technically-equivalent elements. In practice, all the materials used, as well as the dimensions, can be any according to requirements.

The invention claimed is:

1. A safety capsule for a container, comprising:

a cap (2) comprising a thread (20);

a cover (3) comprising a base (30) and a lateral wall (31) that extends from said base (30); said base (30) and said lateral wall (31) overlying said cap (2);

press-fit engagement means (5) comprising fins (34) on the underside of the base (30) and seats (25) located on an upper surface of the cap (2) that enables transmission of rotational motion from the cover (3) to the cap (2) when the press-fit engagement means (5) are engaged;

a strip (60) integrally molded with the cover (3) wherein said strip (60) is folded from the lateral wall (31) inside of the cover (3) and extends upward towards the base (30) starting from a fold line (83) at one end (32) of the cover (3), said strip further including a wedge (602) at an upper end (601); and a stopping abutment (61) integral with said cap (2) and comprising an inset groove (610); wherein the strip (60) and the stopping abutment (61) permanently prevents the removal of the cap (2) from the cover (3) and wherein said wedge (602) is configured to be received into said inset groove (610).

2. The capsule according to claim 1, characterised in that the cap (2) comprises a lateral flank (21) in which said abutment (61) is positioned.

3. The capsule according to claim 2, characterised in that the flank (21) of the cap (2) comprises a projection (22) in which said abutment (61) is positioned and which extends along an imaginary annular line.

4. The capsule according to claim 3, characterised in that the flank (21) of the cap (2) comprises an annular portion (23) that extends between said annular projection (22) and an end (24) of the cap (2); said strip (60) is located at least partly in a gap (62) placed between the lateral wall (31) of the cover (3) and said annular portion (23) of the cap (2).

5. The capsule according to claim 4, characterised in that the capsule comprises a plurality of adjacent strips (6) abutted by one or more projections (22) positioned on the flank (21) of the cap (2) and interposed between the lateral wall (31) of the cover (3) and the annular portion (23) of the cap (2).

6. The capsule according to claim 4, characterised in that the press-fit engagement means (5) determines a maximum axial stroke of the cover (3) with respect to said cap (2); said annular portion (23) extending axially for a longer length with respect to said maximum axial stroke.

7. The capsule according to claim 1, characterised in that said strip (60) overlies the lateral wall (31) of the cover (3) without any interposed elements.

* * * * *